US005491281A

United States Patent [19]

Bhat

[11] Patent Number: 5,491,281

[45] Date of Patent: Feb. 13, 1996

[54] REACTIVE EXOTHERMIC LIQUID - INORGANIC SOLID HYBRID PROCESS

[75] Inventor: Vasanth Bhat, Cincinnati, Ohio

[73] Assignee: Bhat Industries, Inc., Cincinnati, Ohio

[21] Appl. No.: 241,751

[22] Filed: May 12, 1994

[51] Int. Cl.[6] ..... A62D 3/00

[52] U.S. Cl. ..... 588/207; 588/205; 588/248

[58] Field of Search ..... 588/205, 207, 588/248

[56] References Cited

U.S. PATENT DOCUMENTS

| | | | |
|---|---|---|---|
| 4,018,679 | 4/1977 | Bolsing | 210/36 |
| 4,327,027 | 4/1982 | Howard et al. | 260/340.3 |
| 4,329,090 | 5/1982 | Teague et al. | 405/263 |
| 5,108,647 | 4/1992 | Bolsing | 252/182.12 |
| 5,186,742 | 2/1993 | Hoffman et al. | 75/773 |
| 5,234,485 | 8/1993 | Bolsing | 71/27 |

FOREIGN PATENT DOCUMENTS

| | | | |
|---|---|---|---|
| 3918716 | 6/1990 | Germany | 588/207 |
| 58-79509 | 5/1983 | Japan . | |

OTHER PUBLICATIONS

Fate of Polychlorinated Biphenyls (PCBs) in Soil Following Stabilization with Quicklime by Robert L. Einhause, Issa Honarkhah, Ptricia Erickson, EPA/600/2-91-052 Sep. 1991.

*Primary Examiner*—Gary P. Straub
*Assistant Examiner*—Timothy C. Vanoy
*Attorney, Agent, or Firm*—Frost & Jacobs

[57] ABSTRACT

A process utilizing a reactive exothermic liquid-inorganic solid hybrid, for the treatment of in-situ waste materials and in-process hazardous materials, including organic materials having contained therein polychlorinated biphenyls (PCBs). The process makes possible the utilization of heat from exothermic reactions for breaking down PCBs in particular.

8 Claims, No Drawings

REACTIVE EXOTHERMIC LIQUID - INORGANIC SOLID HYBRID PROCESS

FIELD OF THE INVENTION

This invention relates to a process utilizing a reactive exothermic liquid-inorganic solid hybrid, for the treatment of in-situ waste materials and in-process hazardous materials, including organic materials having contained therein polychlorinated biphenyls (PCBs). More specifically, this invention discloses a process which is suitable for treating and rendering inert the above-mentioned materials.

BACKGROUND OF THE INVENTION

U.S. Pat. No. 5,234,485 to Bolsing discloses a method of immobilizing a contaminant comprising mixing the contaminant with a reaction partner which is capable of chemically interacting with the contaminant to form a water-insoluble reaction product. The reaction partner is mixed in the form of a hydrophobic solid preparation, which is either obtained by grinding the reaction partner with an inert material and treating it with a hydrophobic agent or a material which contains the educt or reaction product of a dispersion by chemical reaction preliminary treated with a hydrophobic agent, the mixture being conducted to form a soil or soil-like material with cohesive constituents of a clay-like structure. The Bolsing compositions may comprise stearic acid, alcohol, quicklime and water. These compositions specifically call for mixing the quicklime and water before contacting the quicklime with the waste or hazardous material. Thus, Bolsing teaches away from the present invention.

U.S. Pat. No. 4,018,679 to Bolsing (Bolsing '679) discloses a method of rendering harmless an oily waste material comprising mixing an alkaline earth metal oxide with a surface active agent which delays reaction between the alkaline earth metal oxide and water, combining the mixture with the oily material, and reacting the alkaline earth metal oxide charged with the waste material with approximately the stoichiometric amount of water to convert the alkaline earth metal oxide to the hydroxide. The alkaline earth metal oxide is preferably calcium oxide and advantageously it is also mixed with a hydrophobizing agent prior to mixture with the oily waste material. Proportions are desirably such that the end product is a solid which can be used as a lining in road construction and at dump sites. The Bolsing '679 compositions may comprise quicklime, water, a stearic acid and alcohols. Bolsing '679 does not teach or suggest using its process for breaking down PCB containing waste or hazardous material. Bolsing '679 also teaches to reduce the exothermic heat generated by including magnesium oxide with calcium oxide. On the other hand, the present invention recognizes that higher temperatures (400° to 600° F.) are optimally suited for breaking down PCB containing waste and hazardous material. Additionally, Bolsing '679 teaches that calcium hydroxide absorbs the oily waste. Conversely, in the present invention, absorption of the waste/hazardous material occurs before reaction between water and quicklime. Thus, Bolsing '679 teaches away from the present invention.

U.S. Pat. No. 5,108,647 to Bolsing ("Bolsing '647") discloses a method of dehalogenating a halogenated hydrocarbon in the presence of a nucleophilic reaction partner, comprising dispersing the halogenated hydrocarbon by chemical reaction (DCR), and dehalogenating the resulting finely dispersed reaction product by means of a strictly chemical conversion with the nucleophilic reaction partner at a temperature between ambient temperature and approximately 950° F. Bolsing '647 does not teach or suggest the coating of the quicklime with an aliphatic salt of sodium or the like for the purpose of rendering the quicklime organophilic, prior to contacting the quicklime with the halogenated hydrocarbon (waste). In fact by teaching that the halogenated hydrocarbon (waste) is contacted with untreated quicklime, Bolsing '647 teaches away from the present invention. Additionally, by teaching the use of external heating in most if not all of the disclosed examples, Bolsing '647 again teaches away from the present invention.

U.S. Pat. No. 5,186,742 to Hoffman et al., discloses a process wherein arc dust waste produced by electric arc furnaces are conducted to silos and converted to a reusable co-product by means of an addition of a special blend of high calcium and dolomitic quicklime, calcium stearate and pulverized waste paper. The mixture is pressed into compact pellets which, due to their impact integrate and improved shelf life can be pneumatically conveyed intact into storage silos for recycling of the waste electric arc flue dust into the furnace melt. Compliments of the arc-dust deemed leachable and hazardous in landfills such as zinc, lead and chromium are increased in concentration to a point where it is economical to extract them for resale. Hoffman's compositions for converting arc-dust waste to a useful product may comprise quicklime, calcium stearate and pulverized waste paper.

Japanese abstract number 58-79509 to Tashiro discloses another use of quicklime and slaked lime (an OH containing compound), in connection with a waste treatment process.

U.S. Pat. No. 4,329,090 to Teague et al. discloses a method for treating surface earth layers to achieve stabilization, strength and permeability, by slaking quicklime in a mixing tank so as to cause elevated temperatures and so as to form a hydrated lime slurry and working said slurry into the soil to be stabilized. There is no suggestion or motivation in Teague to use quicklime for the breakdown of waste or hazardous materials.

In September 1991, the United States Environmental Protection Agency published an investigative report entitled "Fate of Polychlorinated Biphenyls (PCBs) in Soil Following Stabilization with Quicklime." This report dealt with the reports of researchers on destruction of PCBs in contaminated soil by the application of quicklime. EPA observed that these research reports were based on retrospective data from site remediation programs, anecdotal information and results of one bench-scale project. EPA investigation was conducted to verify claims that use of quicklime alone can promote decomposition of PCBs. Based on this investigation, EPA concluded that the use of quicklime (as suggested by researchers), as an in-situ treatment for removal of PCBs was not supported by their findings. The following excerpts from the EPA report are telling:

> Minimal evidence of PCB dechlorination was observed . . . The destruction of PCBs by application of quicklime to contaminated soil, sediment or sludge has thus not been demonstrated, either by controlled benchtop experiments or by retrospective analysis of a sample from a remediation site where the process was applied. Evidence of PCB volatilization suggests that use of reactive quicklime as an in-situ treatment may even be contraindicated due to the potential for migration of PCBs as vapor or airborne particulates . . . (emphasis supplied)

This report clearly teaches away from utilizing quicklime to break down waste or hazardous materials containing PCBs.

SUMMARY OF THE INVENTION

It is the primary object of the present invention to provide a new method for the simultaneous and stepwise treatment of in-situ waste materials and in-process hazardous materials containing PCBs or other organics.

It is yet another object of the present invention to provide a process which makes possible the utilization of heat from exothermic reactions for breaking down PCBs in particular.

It is another object of the present invention to provide a process for waste and hazardous materials treatment which lends itself to operation and successful breakdown of the PCBs at lower temperatures than possible in prior art processes.

In accordance with the present invention there is provided a method for the treatment of in-situ waste materials and in-process hazardous materials, said materials including PCBs and other organics, the method comprising the steps of: preparing a mixture comprising at least 70 weight percent quicklime, 0.1 to 10 weight percent of products of reaction between an aliphatic acid composition consisting of 50 weight percent palmitic acid, 39 weight percent stearic acid, 5 weight percent oleic acid, 2.5 weight percent margaric acid, 2.5 weight myristic acid and 1 weight percent pentadecanoic acid and an organic or inorganic OH containing substance; contacting said mixture with said waste to be treated, the weight ratio of said mixture to the dry weight of said waste ranging from 1:5 to 1:10; absorbing said materials into said mixture; adding water to said waste containing mixture, the weight of said mixture being greater than that of said water; causing an exothermic reaction between said mixture and the water thereby generating a temperature of at least 200° F.; and breaking down said waste due to said exothermic reaction by the formation of a water insoluble powder.

DETAILED DESCRIPTION OF THE PREFERRED EMBODIMENT

The fundamental concepts of the present invention are as follows: a particular liquid is chosen such that when it comes into contact with a specific solid, an exothermic or heat-generating reaction occurs.

PCBs are complex organic molecules. Quicklime or calcium oxide, which is an inorganic chemical, reacts with PCBs and with other organic molecules, when rendered organophilic. This occurs when the quicklime is treated with a nucleophilic reaction partner and a catalyst. The treated quicklime is contacted with the PCB containing material (waste or hazardous), which breaks down (by conversion into water insoluble materials comprising dechlorinated biphenyls and other organics, inorganic alkali chlorides and oxychlorides), at temperatures in excess of about 200° F. The heat generating (exothermic) reaction is achieved by contacting the treated quicklime and PCB containing material (waste or hazardous) with water or other suitable liquid. Optimal reaction temperatures for the breakdown of organic compounds like PCBs would be between 400° and 600° F. Varying the water content has a definite impact upon the temperature generated. It is believed that the organophilic quicklime molecule interacts with the PCB, which then reacts at the favorable temperature conditions by forming salts, thereby being stabilized.

Conversion of the quicklime into an organophilic compound is the first step. This conversion is achieved by mixing and coating quicklime with aliphatic salts of sodium. The nucleophilic reaction partner and catalyst can be sodium hydroxide and/or sodium alkoxide. Additional reagents in some applications can be calcium monobasic phosphate, sodium metabisulfite and magnesium compounds. Sulfonated alkali phosphate and sulfite additives have also been employed to render hazardous materials non-hazardous. The combined mixture (prior to reaction with the PCB containing material) is referred to as "alkasol."

Optimum range of alkasol to water is 3 to 1 or greater. Quite possibly sodium stearate would also achieve the same effect as a combination of, for example stearic acid as the source of stearate and sodium hydroxide. This is because stearic acid and sodium hydroxide gives sodium stearate. The alkasol could comprise about 1 weight percent stearic acid (or other aliphatic salt of sodium), approximately 0–1 weight percent sodium hydroxide and the rest quicklime. Aliphatic salts of sodium can also be formed by combining acids such as stearic acid, palmitic acid, oleic acid, margaric acid, myristic acid, pentadecanoic acid, etc; and sodium hydroxide and/or sodium alkoxide.

It is essential that as much surface area as possible be provided and therefore it is preferable to grind the alkasol mixture and bring it down to a fine powder. The coarser the mixture, the less effective it is in bringing about the high temperature. However, the powder works whether it is fine or coarse. Finer powder, especially as the powder gets very, very fine, creates environmental problems associated with dust emanation. Hence, there is a happy medium between a very coarse material and an extremely fine material. Particle sizes ranging from –60 mesh to –325 mesh are acceptable. The idea behind coating the quicklime with the stearate is to prevent the quicklime from coming into direct contact with water first before absorption of the PCB containing waste/hazardous material and to make the quicklime organophilic, i.e. facilitate the absorption of organics. If the quicklime comes into contact with water, an exothermic reaction is started. The stearate retards this chemical reaction until all of the organic molecules are absorbed so that there are no organic molecules surrounding the powder if you look at the powder at a microscopic scale. All of the organic molecules are absorbed and then the water is exposed to the powder.

Examples of specific compositions which have been found to be satisfactory for providing in-situ waste treatment on in-process hazardous materials treatment and breaking down PCBs are disclosed as follows:

Table I

90–98% Quicklime (Dravo Lime Company)

0.1–10% 50 weight percent palmitic acid, 39 weight percent stearic acid, 5 weight percent oleic acid, 2.5 weight percent margaric acid, 2.5 weight myristic acid and 1 weight percent pentadecanoic acid 0.1–10% Caustic Soda (Ashland Chemical, Inc.)

Table II

70–98% Quicklime 0.1–10% 50 weight percent palmitic acid, 39 weight percent stearic acid, 5 weight percent oleic acid, 2.5 weight percent margaric acid, 2.5 weight myristic acid and 1 weight percent pentadecanoic acid 0.1–10% Caustic Soda 0–25% Sulfonated Alkali Phosphates and Sulfites.

Thus, it is apparent that there have been provided in accordance with the present invention, compositions and a method suited for treating waste/hazardous materials which contain PCBs for the breakdown of the PCBs, which fully satisfy the objects, aspects and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications and variations which fall within the spirit and scope of the appended claims.

I claim:

1. A method for the treatment of in-situ waste materials and in-process hazardous materials, said materials comprising PCBs, the method comprising the steps of:

preparing a mixture comprising at least 70 weight percent quicklime, 0.1 to 10 weight percent of aliphatic salts of sodium prepared by reacting an aliphatic acid composition consisting of 50 weight percent palmitic acid, 39 weight percent stearic acid, 5 weight percent oleic acid, 2.5 weight percent margaric acid, 2.5 weight percent myristic acid and 1 weight percent pentadecanoic acid with a compound selected from the group consisting of sodium hydroxide, sodium alkoxide, and mixtures thereof;

contacting said mixture with said materials to be treated, the weight ratio of said mixture to the dry weight of said waste ranging from 1:5 to 1:10;

absorbing said materials into said mixture to form a second mixture;

controlling the amount of water in said second mixture to achieve;

causing an exothermic reaction between said mixture and water while generating a temperature of at least 200° F.; and breaking down said materials due to said exothermic reaction with the formation of a water insoluble powder.

2. The method of claim 1 wherein said mixture comprises up to 98% quicklime.

3. The method of claim 2 wherein the particle size of said quicklime is less than 60 mesh.

4. The method of claim 2 wherein said temperature is between 400° and 600° F.

5. The method of claim 2 wherein said aliphatic salt 4 of sodium constitutes 1 percent of said mixture.

6. The method of claim 2 wherein said aliphatic salts of sodium are prepared by reacting said aliphatic acid composition with from 0.1 to 1 weight percent of said sodium hydroxide, sodium alkoxide and mixtures thereof.

7. The method of claim 2 wherein said mixture further comprises up to 25 weight percent sulfonated alkali phosphates and sulfites.

8. The method of claim 1 wherein the ratio of said mixture to water in said second mixture is controlled to about 3:1.

* * * * *

UNITED STATES PATENT AND TRADEMARK OFFICE

CERTIFICATE OF CORRECTION

PATENT NO. : 5,491,281
DATED : February 13, 1996
INVENTOR(S) : Vasanth Bhat

It is certified that error appears in the above-indentified patent and that said Letters Patent is hereby corrected as shown below:

Column 6, line 17, claim 5, please delete "4".

Signed and Sealed this

Twenty-third Day of July, 1996

*Attest:*

Bruce Lehman

BRUCE LEHMAN

*Attesting Officer*

*Commissioner of Patents and Trademarks*